US009970633B2

(12) United States Patent
Simmerlein

(10) Patent No.: US 9,970,633 B2
(45) Date of Patent: May 15, 2018

(54) LAMP SHADE

(71) Applicant: Thomas Simmerlein, Norderstedt (DE)

(72) Inventor: Thomas Simmerlein, Norderstedt (DE)

( * ) Notice: Subject to any disclaimer, the term of this patent is extended or adjusted under 35 U.S.C. 154(b) by 0 days. days.

(21) Appl. No.: 15/248,017

(22) Filed: Aug. 26, 2016

(65) Prior Publication Data

US 2017/0276325 A1 Sep. 28, 2017

(30) Foreign Application Priority Data

Mar. 24, 2016 (DE) ..... 20 2016 101 626 U
May 10, 2016 (DE) ..... 20 2016 102 486 U

(51) Int. Cl.

| | |
|---|---|
| ***F21V 17/00*** | (2006.01) |
| ***F21V 17/02*** | (2006.01) |
| ***F21V 1/12*** | (2006.01) |
| *F21W 121/00* | (2006.01) |

(52) U.S. Cl.

CPC ..... *F21V 17/002* (2013.01); *F21V 1/12* (2013.01); *F21V 17/02* (2013.01); *F21W 2121/00* (2013.01)

(58) Field of Classification Search

CPC ..... F21V 17/002; F21V 17/02; F21V 1/12
See application file for complete search history.

(56) References Cited

U.S. PATENT DOCUMENTS 4,539,631 A * 9/1985 Lieberman ..... F21V 1/00 362/351
9,328,893 B2 5/2016 Strotmann et al.
2015/0085483 A1 3/2015 Strotmann et al.

FOREIGN PATENT DOCUMENTS

DE 3718369 A1 12/1988
DE 202004014269 U1 12/2004

* cited by examiner

*Primary Examiner* — Thomas M Sember
(74) *Attorney, Agent, or Firm* — Howson & Howson LLP

(57) ABSTRACT

A lamp shade is provided for covering a light source. The lamp shade has a hoodlike base body which is open at least at the bottom and at least partly transparent, which is placed over the light source and covers it. The base body can have on its outer surface at least one encircling indentation, in which a decorative ring is adapted to be fitted and braced there.

20 Claims, 3 Drawing Sheets

LAMP SHADE

BACKGROUND

The invention concerns a lamp shade for covering a light source, having a hoodlike base body which is open at least at the bottom and at least partly transparent, which is placed over the light source and covers it.

Light or lamp shades are known in the most diverse of embodiments. They serve in particular to cover the light source in order to avoid glare effects. The lamp so covered also becomes an optically attractive spatial object. Lamp shades are often made from a transparent, translucent textile material or a flexible plastic material and held by a supporting frame over the light source so that a direct visual contact with the light source is prevented. It is also known how to make the lamp shades from rigid plastic, ceramic, or glass.

Furthermore, lamp shades are often provided with ornamentation or painting, so that they can be regarded sometimes as objects of art. There is always only one graphic painting or ornament present on one lamp shade. If another design is desired, it is then necessary to replace the entire lamp shade. This is relatively costly and requires an increased storage requirement for the keeping of the unused lamp shades, since these are bulky and delicate.

SUMMARY

The problem which the invention proposes to solve is to configure a lamp shade of the kind described above so that a different design can be accomplished with simple means.

The problem is solved according to the invention in that the base body has on its outer surface at least one encircling indentation, in which a decorative ring is fitted and supported there. The decorative ring can consist of an at least partly transparent material. As a result, the outer appearance of the lamp shade can be changed by replacing only the decorative ring. No tool is needed for this, since the ring is easily placed in the indentation and held there securely.

Alternatively, it can be provided that the base body has on its outer surface at least one at least partly encircling projection, on which a decorative ring is fitted and braced there. The base body can then be easily fabricated. The decorative ring has an inner surface corresponding to the outer surface, so that it is held on the base body free of play and without clamping.

Specifically, the arrangement is such that the base body has a contour tapering upward at least in the region of the indentation, whose outer section is adapted to the inner side surface of the decorative ring. The decorative ring can then be placed easily over the base body from above until it lies in the indentation. Thanks to the downward widening section of the base body, the decorative ring remains in this position and cannot slip out.

It can furthermore be provided that the indentation has at least one encircling shoulder, against which a corresponding inwardly pointing projection or the lower end face of the decorative ring abuts. The shoulder and the projection preferably run substantially horizontal or at an acute angle with the horizontal. In this way, the decorative ring is held securely and without clamping on the base body in the indentation.

It can furthermore be provided that the indentation has at least one encircling side surface segment which runs at an acute angle in the direction of or parallel to the lengthwise axis of the base body and in the mounted condition lies against the one corresponding encircling inner surface segment of the decorative ring. It is then advisable for the projection to be arranged at the lower end and the inner surface segment at the upper end of the decorative ring and for the shoulder to be arranged at a lower region and the side surface segment at an upper region of the indentation of the base body. Thanks to this arrangement, the decorative ring has no thin or pointed margin regions and therefore is relatively stable and can be easily handled.

According to one preferred embodiment of the invention, the dimensions and especially the wall thickness variation of the decorative ring are chosen such that the outer surface of the decorative ring in the mounted state merges at least approximately flush with the outer surface of the base body. Furthermore, looking in the longitudinal section, the encircling upper and lower outer edges of the indentation can be joined together by the decorative ring, forming a segment of a circular arc. The lamp shade thus has a substantially smooth surface in the mounted condition of use and is thus especially optically appealing. In particular, the removable decorative ring cannot readily be recognized as such, so that the lamp shade appears to be a single piece.

According to a further modification of the invention, the decorative ring is composed of at least two partial rings, which fit one onto the other in the indentation of the base body. The indentation can be configured correspondingly larger for this. The lower end face of the lowermost partial ring then lies against the projection or shoulder of the base body. The lower end face of the next partial ring rests against the upper end face of the partial ring underneath. The upper end face of a lower partial ring runs preferably substantially horizontal or at an acute angle to the horizontal. The lower end face of an upper partial ring is fashioned accordingly.

Thus, any desired number of partial rings can be inserted one on top of another in the indentation. A lower partial ring thus forms the support for the next partial ring. The uppermost partial ring has at its upper edge an encircling inner surface segment, which runs at an acute angle in the direction of or parallel to the lengthwise axis of the base body and thus lies against the associated upper side surface segment of the indentation of the base body.

In this way, for example, three partial rings can be placed one on top of the other in the indentation. The partial rings form the decorative ring, which is joined flush in the indentation. Thus, by different colorations of the individual partial rings, optically appealing patterns can be created.

The base body or the decorative ring or its partial rings can be fashioned individually in any desired manner. It is only necessary for a secure supporting of the decorative ring that the base body widens downwardly. The decorative ring is then held firmly on the base body. Thanks to the indentation, furthermore, a flush merging of the outer surface of the decorative ring with the outer surface of the base body is achieved. In particular, the decorative ring can be held on the base body without self clamping, so that it can be easily removed once again.

Preferably, the base body and the decorative ring are circular ring shaped, oval, elliptical or polygonal in cross section. This forms a closed contour, looking in transverse section. In particular, the circular round shape is preferred, since then any desired rotation of the decorative ring relative to the base body is possible.

The base body and/or the decorative ring can consist of glass or ceramic or plastic. This material has a sufficient strength and transparency, so that attractive lighting effects can be accomplished. Thanks to the choice of the decorative ring, the most diverse lighting effects can be achieved when the lamp shade is illuminated from the inside. It is also possible, instead of a closed decorative ring surface, to provide a wire mesh or an interrupted ring, so that interesting shadow effects can likewise be achieved.

In the position of use, the base body with the decorative ring stands over at least one light source. The dimensions of the base body are chosen so that it fits over a light source without touching it. The base body can be closed at the top. This constitutes no problem, for example, when using a LED light source, since this produces no exhaust gases at all. The resulting warmth is dissipated via the surface of the base body.

For an especially inviting illumination, however, it can be provided that the lamp shade is placed over a candle and especially over a tea light. It is then favorable for the base body to have an upper opening. The candle is then supplied with enough oxygen, and the combustion gases can escape. Also, with a central upper opening, there is no danger of the base body becoming blackened at the bottom.

According to a further modification of the invention, a support frame is provided, which is braced against the margin of the opening in the base body and on which is mounted a propeller with propeller blades able to turn about a vertical axis, and on at least one propeller blade there is supported a decorative element by a bracket, so that the decorative element is situated at the height of the decorative ring at a distance from its outer surface. The ascending heat of the light source places the propeller in rotary motion, so that the decorative elements move relative to the lamp shade.

The support frame comprises at least three outwardly pointing support arms, which meet at the center of the support frame and whose free ends lie at the margin of the opening in the base body. Thus, the support frame can be quickly removed when not in use. The propeller can be mounted on a tip extending vertically to the center of the support frame. Such a mounting is sufficient for these purposes.

Furthermore, the base body can stand on a mat on which the light source is arranged and whose outer dimensions are larger than or equal to those of the outer lower margin of the base body. This forms a compact structure of the lamp, which can also be easily moved.

The decorative ring preferably has a height corresponding to around 25% to 60% of the height of the base body. Thus, an optically attractive motif can be depicted on the decorative ring. It is also possible to arrange several decorative rings one on top of another on the base body. For this, the base body has several indentations or projections lying one about another, in which or on which appropriately dimensioned decorative rings can be held.

BRIEF DESCRIPTION OF THE DRAWINGS

The invention will be explained more closely below with the help of the schematic drawing. There are shown.

DETAILED DESCRIPTION

Figure 1:
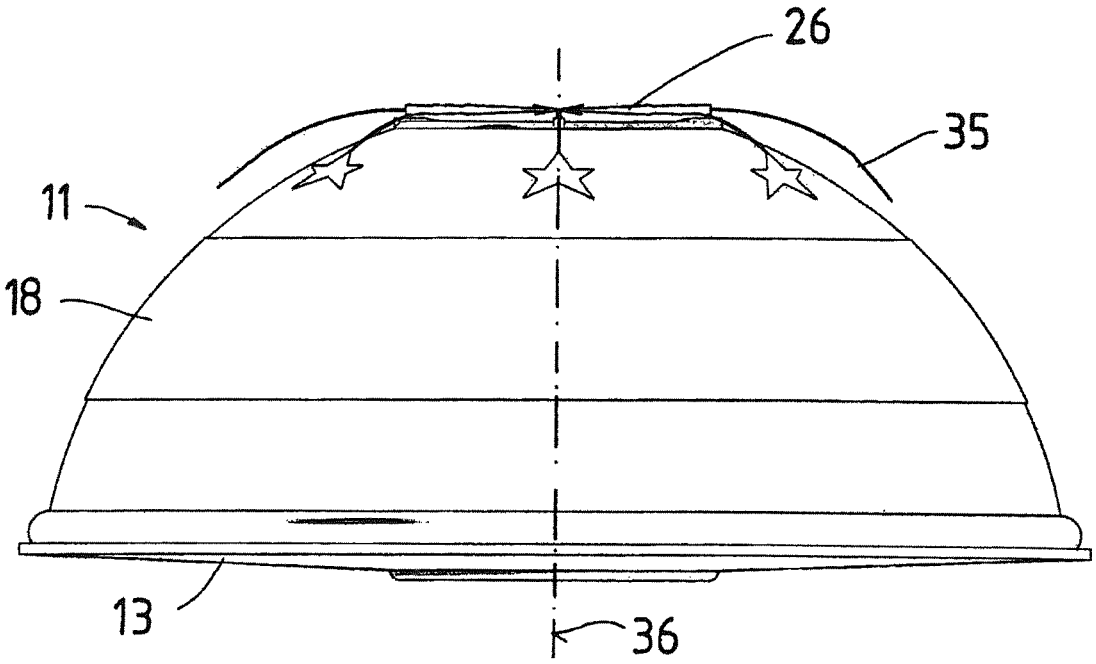
FIG. 1, the side view of a lamp with a lamp shade according to the invention.

FIG. 1 shows a lamp with a lamp shade 11, having a round circular shape in cross section and being fashioned as a hood. The longitudinal section of the lamp shade can be fashioned as a bell, an ellipse, or a partial circle in longitudinal section. It forms a downwardly open hood or shell, which can be placed over a light source 12, such as a tea light. The light beams out through the partly transparent or milky lamp shade 11 and produces a pleasant illumination.

The lamp shade 11 stands on a dish-shaped mat 13, whose outer diameter is larger than or equal to the outer diameter of the lower margin 14 of the lamp shade. The light source 12 stands on the mat 13. Above this is the lamp shade 11, which thus prevents a direct visual contact with the light source 12.

The hood-shaped lamp shade 11 has a base body 15, which possesses an encircling indentation 17 on its outer surface 16, in which a decorative ring 18 is received. Specifically, the arrangement is such that the indentation 17 is braced by its inwardly pointing substantially horizontal lower shoulder 19 against the outer surface 16 of the base body 15. At its upper boundary, the indentation 17 has an approximately vertically encircling side surface segment 20, which emerges into the outer surface 16 of the base body.

The outer surface 16 of the base body 15 and also the outer surface 21 of the indentation 17 have a downwardly widening section, looking in longitudinal section. In this way, it is possible to insert the decorative ring 18 from above in the indentation 17. In this position, the decorative ring is securely held in the indentation.

For this, the decorative ring 18 has an inner surface 22 which corresponds to the outer surface 21 of the indentation 17 turned toward it and which is slightly larger. Furthermore, the decorative ring 18 has a horizontal surface 23 at its lower margin, which in the mounted state lies against the horizontal shoulder 19 of the indentation 17. The horizontal support surface can also be fashioned as an inwardly pointing projection of the ring. At its upper margin, the decorative ring 18 has a vertical encircling inner surface segment 24, which in the mounted state lies against the side surface segment 20 of the indentation 17 of the base body 15, which then faces it.

Furthermore, the dimensions and especially the thickness variation of the decorative ring 18 in the longitudinal section are chosen so that the outer surface of the decorative ring 18 in the mounted state merges flush with the outer surface 16 of the base body 15. Thus, the decorative ring 18 is form fitted without shoulders and forming a smooth surface in the indentation 17 of the base body 15, so that an attractive exterior results.

Basically it is also possible to provide an encircling projection instead of an indentation on the top side, which is fitted to a correspondingly dimensioned decorative ring. However, the decorative ring then always forms a shoulder for the outer surface of the base body.

For different decoration purposes, different decorative rings 18 can be placed on the base body 15 in this way. The decorative rings when not in use can be kept in flat boxes in space-saving manner.

Figure 4:
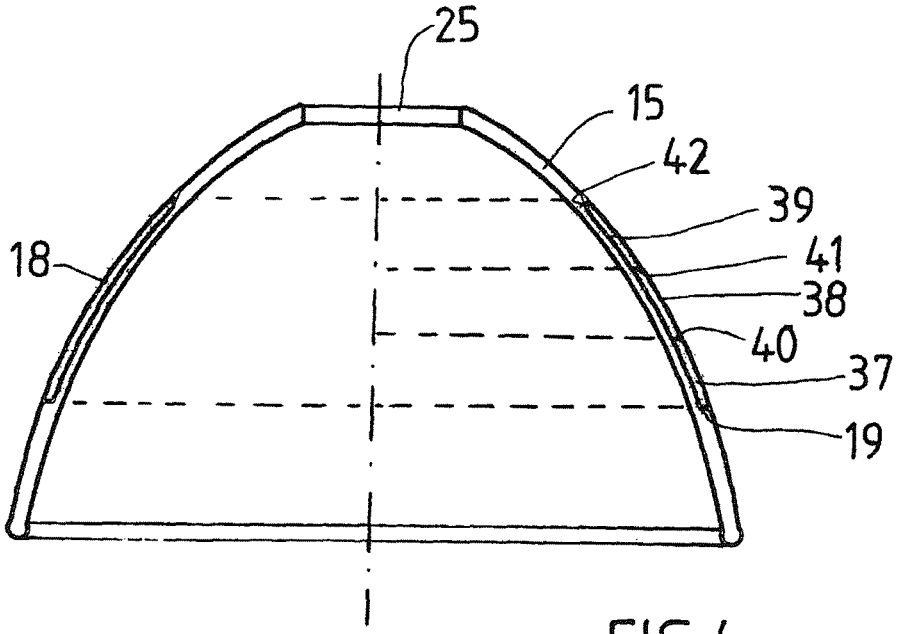
FIG. 4 the lamp shade in the assembled condition in longitudinal section.

As is shown on the right side in FIG. 4, the decorative ring 18 can also be composed of several partial rings 37, 38, 39, which are placed one on top of another to fill the indentation 17. The lowermost partial ring 37 is braced by its lower end face against the shoulder 19 of the base body 15. The upper end face 40 of the lowermost partial ring 37 is fashioned according to the shoulder 19 of the base body and thus forms the support for the partial ring 38 situated above it, whose upper end face 41 is likewise fashioned as the shoulder 19 of the base body and thus forms a support for the uppermost partial ring 39. Its upper margin has a vertical encircling inner surface segment 42, which in the mounted condition lies against the side surface segment 20 of the indentation 17 of the base body 15, which then faces it. Thanks to the conical shape of the base body, the partial rings 37, 38, 39 each have different diameters, so that they cannot get mixed up. In this way, a variety of decorations can be produced.

If the light source 12 is a candle, it is necessary to supply sufficient oxygen or air to the cavity bounded off by the lamp shade 11, where the candle is located in the position of use. Furthermore, it is necessary to carry away the combustion gases formed. For this, the lamp shade 11 has in its upper region a central opening 25, beneath which the candle stands and through which air can enter, on the one hand, and the hot combustion gases can escape, on the other hand. When using an electric light, the lamp shade can also be designed closed at the top.

Figure 5:
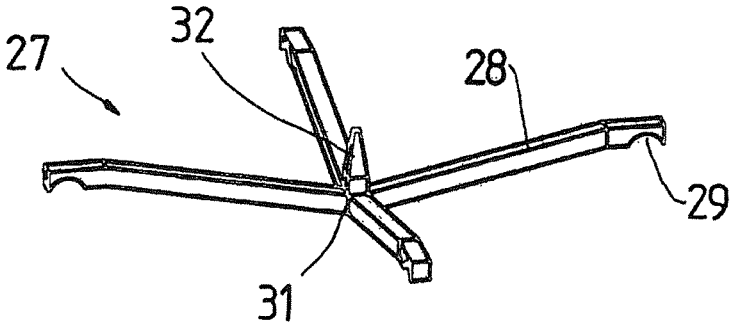
FIG. 5 the support frame in perspective representation.

For further decorative purposes, a propeller 26 can be arranged above the opening 25, being held on a support frame 27 and able to turn about a vertical axis above the opening 25. The support frame 27 in the sample embodiment shown in FIG. 5 has four outwardly directed support arms 28, which are braced against the margin 30 of the central opening 25 by downwardly directed indentations 29 in end position. The support arms 28 meet at a center 31, which have an upwardly directed vertical needle 32 on which the propeller 26 is mounted so that it can turn. The propeller 26 is turned by the warm air rising from the light source 12.

The propeller 26 has several propeller blades 33. Brackets 34 are attached to the propeller blades, arranged symmetrically with respect to the axis of rotation, on which decorative elements 35 are held. The brackets 34 extend downward in an arc and run, like the decorative elements 35, at a distance from the outer surface 16 of the base body and the outer ring surface of the decorative ring 18. In particular, it is provided that the decorative elements 35 are held by the brackets 34 at the level of the decorative ring 18.

Thanks to the ascending warm air of the light source 12 the propeller 26 and thus the decorative elements 35 along the decorative ring 18 rotate. In this way, pleasing optical effects can be produced.

Figure 2:
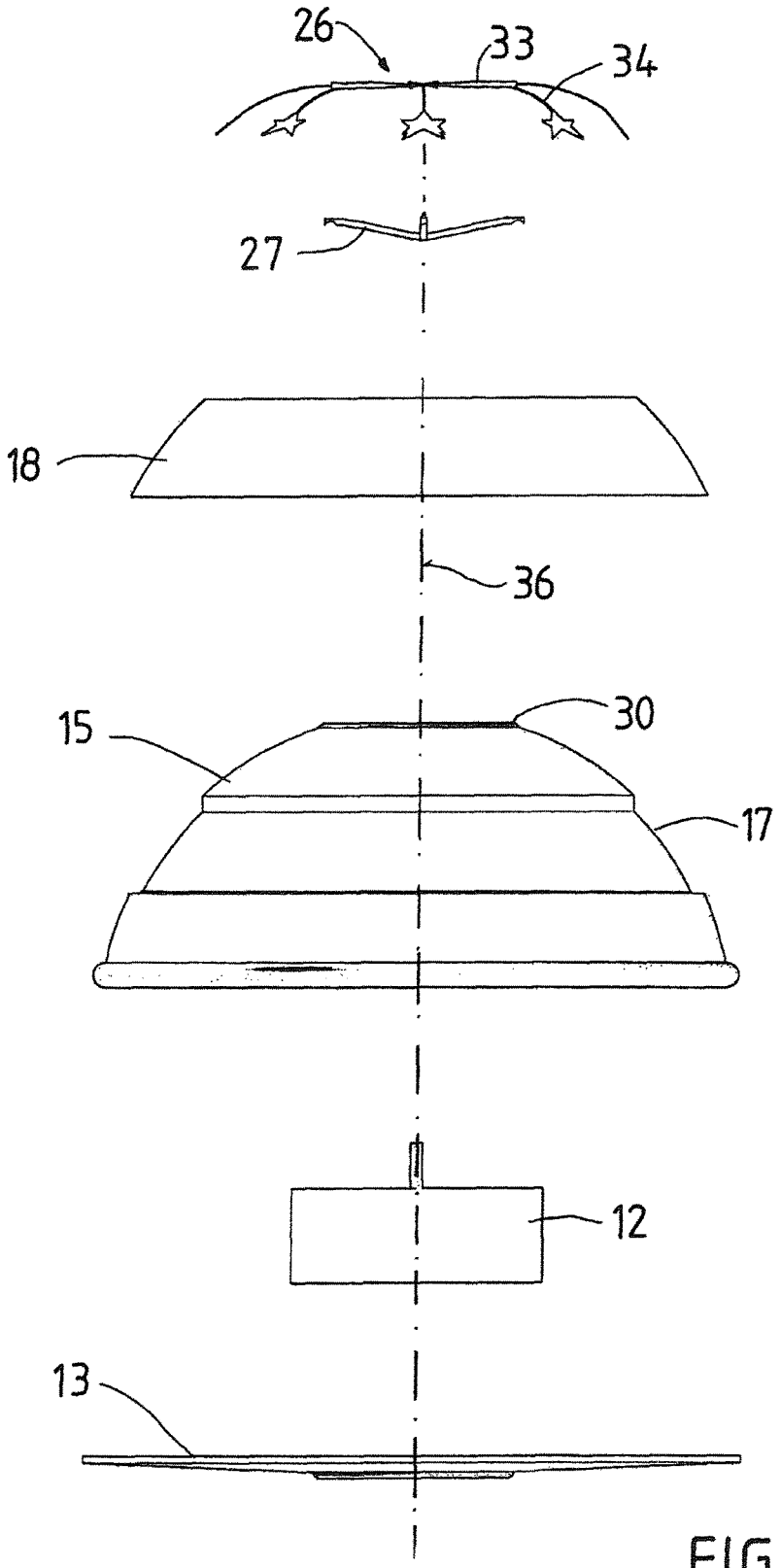
FIG. 2, the lamp of FIG. 1 in an exploded view, taken-apart representation.
Figure 3:
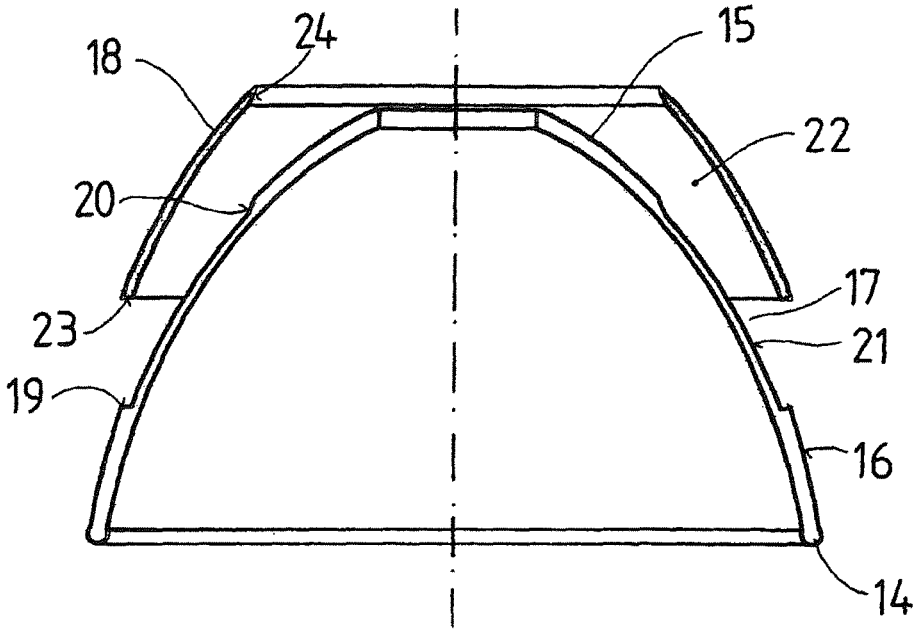
FIG. 3, the lamp shade in partly assembled condition, in longitudinal section.

As is especially evident in FIG. 2, the individual elements of the lamp so formed are arranged along the vertical lengthwise axis 36, and the assembly is done accordingly. Such a lamp consisting of base body, decorative ring, mat, support frame and propeller can be offered as a set. The decorative ring or the propeller with the decorative elements can later be exchanged for other decorative rings or propellers, so that a collection of different lamps can be provided.

The invention claimed is:

1. A lamp shade for covering a light source, comprising a hoodlike base body and a decorative ring placed over the base body, the hoodlike base body being open at least at a bottom thereof and at least partly transparent and being placed over the light source to cover the light source, wherein the base body has an outer surface and at least one at least partly encircling projection on the outer surface, on which the decorative ring is fitted and braced.

2. A lamp shade (11) for covering a light source (12), comprising a hoodlike base body (15) and a decorative ring (18) placed over the base body (15), the hoodlike base body (15) being open at least at a bottom thereof and at least partly transparent and being placed over the light source (12) to cover the light source, wherein the base body (15) has an outer surface (16) and at least one encircling indentation (17) on the outer surface (16), in which the decorative ring (18) is fitted and braced.

3. The lamp shade according to claim 2, wherein the decorative ring (18) consists of an at least partly transparent material.

4. The lamp shade according to claim 2, wherein the decorative ring (18) has dimensions and a wall thickness variation such that an outer surface of the decorative ring in a mounted state on the base body merges at least approximately flush with the outer surface (16) of the base body (15).

5. The lamp shade according to claim 2, wherein the base body (15) and the decorative ring (18) are circular ring shaped, oval, elliptical or polygonal in cross section.

6. The lamp shade according to claim 2, wherein the indentation (17) has at least one encircling shoulder (19), against which a corresponding inwardly pointing projection or a lower end face (23) of the decorative ring (18) abuts.

7. The lamp shade according to claim 6, wherein the shoulder (19) and the projection or lower end face (23) run substantially horizontal or at a shallow angle to horizontal.

8. The lamp shade according to claim 6, wherein the indentation (17) has at least one encircling side surface segment (20) which runs at an acute angle in a direction of or parallel to a lengthwise axis (36) of the base body (15) and in a mounted condition with the decorative ring (18) lies against one corresponding encircling inner surface segment (24) of the decorative ring (18).

9. The lamp shade according to claim 2, wherein the base body (15) has a contour tapering upward, at least in a region of the indentation (17), whose outer section is adapted to an inner side surface (22) of the decorative ring (18).

10. The lamp shade according to claim 2, wherein, looking in longitudinal cross-section, encircling upper and lower outer edges of the indentation are joined together by the decorative ring, forming a segment of a circular arc.

11. The lamp shade according to 2, wherein the decorative ring (18) is composed of at least first and second partial rings (37, 38, 39), such that the second partial ring is supported on and extends above the first partial ring in the indentation (17) of the base body (15).

12. The lamp shade according to claim 11, wherein a lower end face of the second partial ring (38, 39) lies against an upper end face (40, 41) of the first partial ring (37, 38), which end faces (40, 41) run substantially horizontal or at a shallow angle to horizontal.

13. The lamp shade according to claim 2, wherein at least one of the base body (15) and the decorative ring (18) is made of glass, ceramic, or plastic.

14. The lamp shade according to claim 2, wherein the base body (15) has an upper opening (25).

15. The lamp shade according to claim 14, wherein a support frame (27) is provided, which is braced against a margin (30) of the opening (25) in the base body (15) and on which is mounted a propeller (26) with propeller blades (33) able to turn about a vertical axis, and on at least one propeller blade there is supported a decorative element (35) by a bracket (34), so that the decorative element (35) is situated at a height of the decorative ring (18) at a distance from an outer surface of the decorative ring (18).

16. The lamp shade according to claim 15, wherein the support frame (27) comprises at least three outwardly pointing support arms (28), which meet at a center (31) of the support frame (27) and whose free ends lie at the margin (30) of the opening (25) in the base body (15).

17. The lamp shade according to claim 16, wherein the propeller (26) is mounted on a tip (32) extending vertically to the center (31) of the support frame (27).

18. The lamp shade according to claim 2, wherein the base body (15) stands on a mat (13) on which the light source (12) is arranged and whose outer dimensions are larger than or equal to those of an outer lower margin (14) of the base body (15).

19. The lamp shade according to claim 2, wherein the at least one encircling indentation (17) is located on the outer surface (16) of the base body (15) at an intermediate position between the bottom of the base body (15) and a top of the base body (15).

20. A lamp shade (11) for covering a light source (12), comprising:

a hoodlike base body (15) and a decorative ring (18) placed over the base body (15), the hoodlike base body (15) being open at least at a bottom thereof and at least partly transparent and being placed over the light source (12) to cover the light source, wherein the base body (15) has an outer surface (16) and at least one encircling indentation (17) on the outer surface (16), in which the decorative ring (18) is fitted and braced, wherein the indentation (17) has at least one encircling shoulder (19), against which a corresponding inwardly pointing projection or a lower end face (23) of the decorative ring (18) abuts, wherein the indentation (17) has at least one encircling side surface segment (20) which runs at an acute angle in a direction of or parallel to a lengthwise axis (36) of the base body (15) and in a mounted condition with the decorative ring (18) lies against one corresponding encircling inner surface segment (24) of the decorative ring (18), and wherein the projection or lower end face (23) is arranged at a lower end of the decorative ring (18) and the inner surface segment (24) is arranged at an upper end of the decorative ring (18) and the shoulder (19) is arranged at a lower region of the indentation (17) and the side surface segment (20) at an upper region of the indentation (17) of the base body (15).

* * * * *